United States Patent [19]

Flowers

[11] 4,454,907

[45] Jun. 19, 1984

[54] CONTINUOUS CASTING MOLD-STARTING PLUG ALIGNMENT SYSTEM

[75] Inventor: Leonard J. Flowers, Oakmont, Pa.

[73] Assignee: Aluminum Company of America, Pittsburgh, Pa.

[21] Appl. No.: 326,604

[22] Filed: Dec. 2, 1981

[51] Int. Cl.[3] ..... B22D 11/08

[52] U.S. Cl. ..... 164/425; 29/271; 164/440

[58] Field of Search ..... 164/440, 425, 426, 445, 164/446; 29/271, 272

[56] References Cited

U.S. PATENT DOCUMENTS

| | | | |
|---|---|---|---|
| 2,206,888 | 7/1940 | Greenidge | 164/425 X |
| 2,540,451 | 2/1951 | Kelley | 29/272 X |
| 3,286,309 | 11/1966 | Brondyke et al. | 164/440 X |
| 3,305,899 | 2/1967 | Saunders | 164/445 |
| 3,327,768 | 6/1967 | Craig et al. | 164/440 |
| 3,329,200 | 7/1967 | Craig | 164/440 |
| 3,344,845 | 10/1967 | Blessinger et al. | 164/440 X |
| 3,381,741 | 5/1968 | Gardner | 164/440 X |
| 3,384,152 | 5/1968 | Olsen et al. | 164/425 |
| 3,464,482 | 9/1969 | Greenberger | 164/426 |
| 3,474,000 | 10/1969 | Simich | 164/425 X |
| 3,503,437 | 3/1970 | Wilson | 164/426 |
| 3,525,381 | 8/1970 | Leese et al. | 164/425 X |
| 3,593,776 | 7/1971 | Williamson | 164/446 |
| 3,697,393 | 10/1972 | Howle | 164/440 X |
| 3,702,631 | 11/1972 | Sergerie | 164/425 |
| 3,862,659 | 1/1975 | Simons | 164/425 X |
| 3,945,425 | 3/1976 | Foye | 164/440 X |
| 4,159,734 | 7/1979 | Sladkoshteev et al. | 164/426 |
| 4,306,345 | 12/1981 | Dearman | 29/272 |

*Primary Examiner*—Nicholas P. Godici
*Assistant Examiner*—J. Reed Batten, Jr.
*Attorney, Agent, or Firm*—Carl R. Lippert

[57] ABSTRACT

A mold-starting plug alignment system for a horizontal direct chill continuous casting apparauts includes a frame support positionable at the exit of a continuous casting mold and guides attached to the frame support spaced along the periphery of the mold opening. The arrangement also includes an adjustable starter head which is attached to a primary starting block member by an adapter member and which cooperates with the guides to self-align the starting head while inserting the starting head into the mold opening prior to casting.

15 Claims, 6 Drawing Figures

CONTINUOUS CASTING MOLD-STARTING PLUG ALIGNMENT SYSTEM

BACKGROUND OF THE INVENTION

This invention relates to an apparatus for horizontal continuous casting of metal. More particularly, it relates to a device for aligning the starting block in a horizontal continuous casting mold.

Direct chill horizontal continuous casting apparatus typically includes a chilled open-ended mold, including a water box, and a starting block adapted to be inserted into the mold. The starting block is typically moved by a conveyor or roller device into the exit end of the mold to temporarily close the mold for initiation of casting. However, even relatively minor misalignment of the starting block within the mold can result in damage to fragile portions of the mold and water box, especially where the mold opening is of the large size used to produce large ingot for sheet production. Such misalignment can result from lateral shifting of the starting block on the conveyor belt or roller means used for bringing it into position.

Arrangements exist for self-alignment of the bottom block in vertical direct chill continuous casting systems. U.S. Pat. No. 3,847,206 discloses a self-centering bottom block which is slidably mounted on a supporting surface and retaining ring to allow for slight horizontal movement of the bottom block. Guide means on the exterior surfaces of the slidable bottom assembly slide along guide runs which are fixed with respect to the mold bore to center the assembly within the mold bore. The continuous casting apparatus disclosed in U.S. Pat. No. 3,877,508 includes laterally projecting pegs which engage within a tapered ring at the bottom of the mold and a fluid supply under pressure to the underside of the starting block. The block and vertically movable supporting table are arranged so that a fluid forms a thin continuous support film between the periphery of the block and the flat surface of a block support table so that the block may move laterally on the table to be centered automatically when entering the mold prior to casting. Such arrangements, however, are not considered suitable for horizontal continuous casting apparatus because of different structure and orientation considerations. For instance, gravity effects are symmetrical in vertical casting by asymmetrical in horizontal casting.

What is needed, therefore, is a device to facilitate alignment of the starting block in the mold for horizontal direct chill continuous casting apparatus which can be easily used for reducing or eliminating damage of the mold surfaces upon insertion and removal of the starting block. The device should provide a uniform clearance within the mold and be relatively uncomplicated and sure in operation and preferably retrofitable to old equipment.

SUMMARY OF THE INVENTION

In accordance with the present invention, an alignment device is provided in combination with a horizontal direct continuous casting apparatus. The improvement includes a frame support positioned generally about the mold opening and multiple guide means attached to the frame support at spaced intervals along the periphery of the mold opening, especially laterally outward peripheral portions. An adjustable starter head is provided for insertion into the mold prior to casting.

An adapter member located between the starting head and the primary starting block member is rigidly secured by one end to the primary starting block and adjustably secured at the other end to the back face of the starting head. Upon contact of the starting head with the multiple guide means, the starting head moves within the plane of the starting head and transverse to the direction of insertion into the mold. The adapter member includes a means for rigidly securing the starting head to the adapter after insertion of the starting head into the mold and self-alignment therewith in accordance herewith. The improved arrangement is particularly suited to casting molten aluminum and its alloys but is considered useful in horizontal continuous casting of other metals.

DESCRIPTION OF THE PREFERRED EMBODIMENTS OF THE INVENTION

Figure 1:
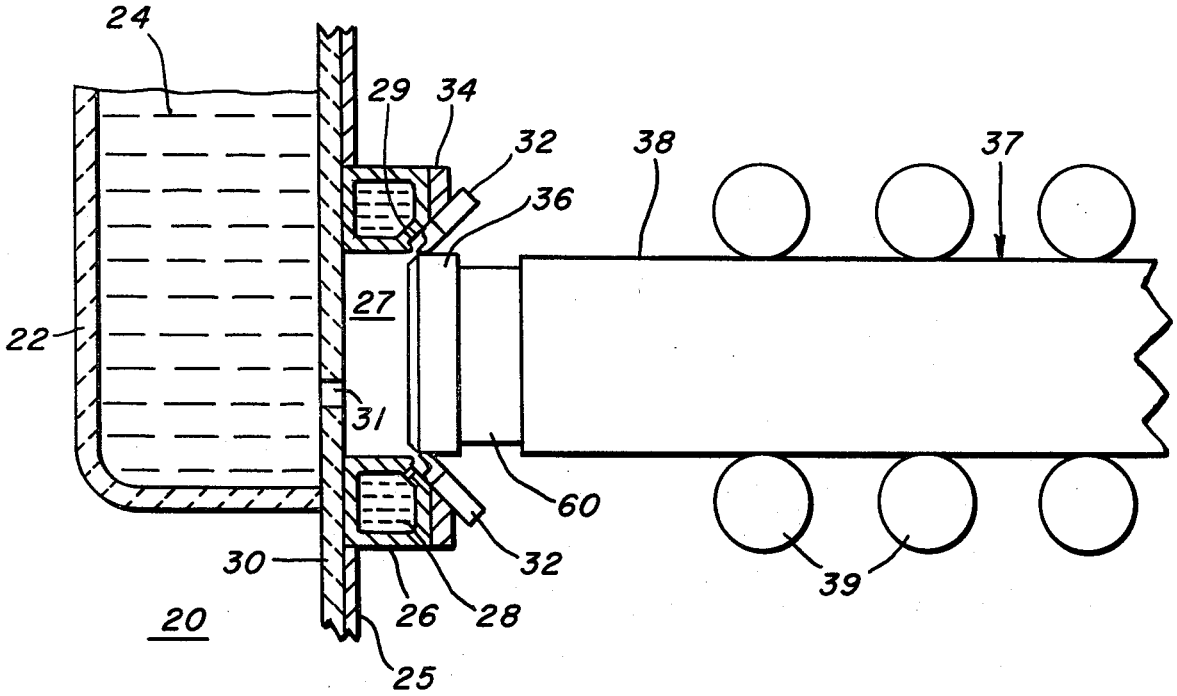
FIG. 1 is a side elevation view partially in cross section of a horizontal direct chill casting apparatus incorporating the present invention.

FIG. 1 illustrates a continuous casting apparatus 20 incorporating the mold alignment fixture of the present invention. Casting apparatus 20 includes a trough or chamber 22 for containing a body of molten metal 24 adjacent open-ended mold 26 which is separated therefrom by a refractory plate member 30 having an opening 31 therethrough to admit molten metal from the supply body 24 into the mold 26. Water 28 within mold 26 chills the mold to solidify molten metal within mold opening 27 in producing a cast ingot, plate or bar which is continuously removed by withdrawal of the solidified metal from the opening. Water exits through holes 29 for direct impingement on solidified or partially solidified ingot exiting mold 26. Solidified metal is withdrawn by the action of conveyor or roller means 39 which, at the initiation of casting, acts upon starting block or plug 38 and thereafter acts upon solidified metal ingot.

The mold alignment device of the present invention includes a guide means 32 attached to a frame support 34 positioned at the exit of mold 26 about mold opening 27. Preferably, multiple guide means are attached to the frame support at spaced intervals along the periphery of the mold opening. The mold alignment device also includes an adjustable starter head 36 to be inserted into mold opening 27 prior to casting. Adjustable starter head 36 is adjustably secured to main starting block 38 by adapter member 60 which includes hereinbelow described means for adjustably securing the starting head to the adapter member to facilitate self-alignment of the starter head 36 within the mold opening 27 by cooperation with guide means 32 and fixing that alignment by rigidizing the connection between starter head 36 and main starting block 38.

Figure 2:
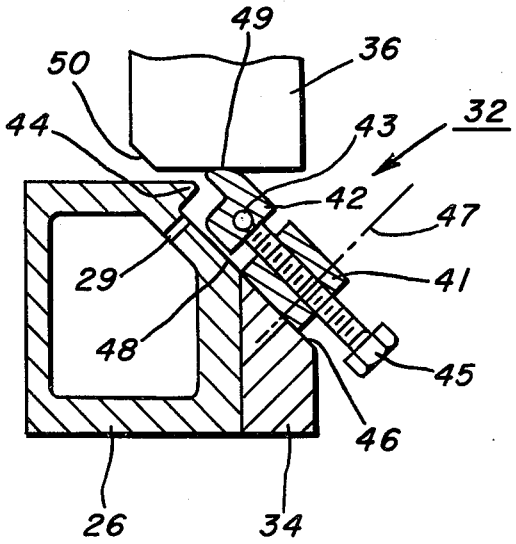
FIG. 2 is an enlarged elevation view in cross section showing the guide means from FIG. 1.
Figure 3:
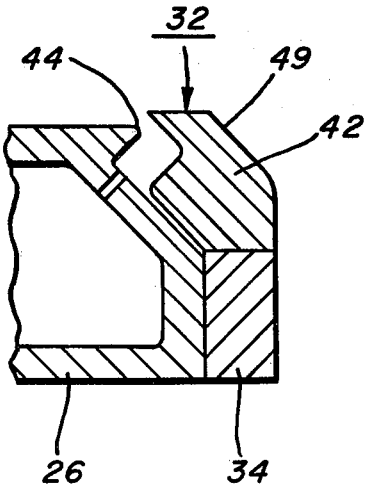
FIG. 3 is an enlarged elevation view in cross section showing an alternative guide means.

Further details of a suitable arrangement for guide means 32 are shown in FIG. 2 wherein anchor or base support member 41 supports adjustment screw 45 for positioning guide shoe 42 inwardly past the inside surface or lip 44 of mold 26, suitably socket 43 or other means being provided to attach guide shoe 42 to screw 45 while allowing for rotation of screw 45 within shoe 42. In the FIG. 2 arrangement support frame 34 includes inclined surface 46 which aligns with or is coplanar with a similar inclined surface 48 on the mold assembly 26 to provide for further or secondary support of guide shoe 42, the surface 48 on the mold 26 converging into the mold opening 27. The arrangement in FIG. 2 where main support frame 34 provides positioning and primary support for the guide means 32 and the mold assembly 26 is adapted to provide secondary support is advantageous in providing ready and adequate support and self-positioning of guide means 32 correct for alignment of starter head 36 within the mold opening 27. Positioning of guide shoe 42 just inside the inner surface or lip 44 of mold assembly 26, for instance 1/16 inch or so, protects the latter from damage by the starter head 36 which suitably can include a slight bevel 50, exaggerated in FIG. 1, to further facilitate proper centering or alignment of starter head in mold 26 by cooperation with guide shoe 42. Guide shoe 42 is shown in FIG. 2 with a curved or arcuate surface 49 for contact with starter head 36. However, relatively flat surfaces also can suffice, such as illustrated in FIG. 3, although some tapered or flared surface 49 converging into the mold opening axis should be provided as shown in FIGS. 2 and 3 to aid in centering the starter plug 36 for the desired alignment. Screw members 45 allow for adjustment of guide shoes 42 where desired, but it should be appreciated that such adjustment, while often preferred, is not necessarily essential. The guide means 32 can be provided as a guide shoe 42 rigidly affixed to frame member 34, as shown in FIG. 3.

Some provision should be made for movement of the guide means 32 away from the mold and the starter block assembly once casting in underway, or before, since guide shoes 42 typically protrude slightly into the mold opening 27 and could damage the emerging ingot or catch on minor surface liquation melting through the surface of a thin-skinned ingot. That is, the guide means should be removable after the starter head 36 is properly aligned and rigidly connected to the main starter block 38 so as to substantially affix the predetermined alignment achieved by the coopertion between the guide means 32 and the laterally guidable starter head 36. The extent of such removal should be sufficient to substantially prevent excessive contact between the guide means and continuously cast ingot exiting mold 26. Excessive contact refers to contact which damages or risks significant damage to the ingot or ingot surface. When referring to the alignment being substantially fixed, it is intended that the gap between mold inside surface or lip 44 and starter head 36 is fixed except for relatively insignificant deflection of main starter block 38 by the weight of starter head 36.

Figure 4:
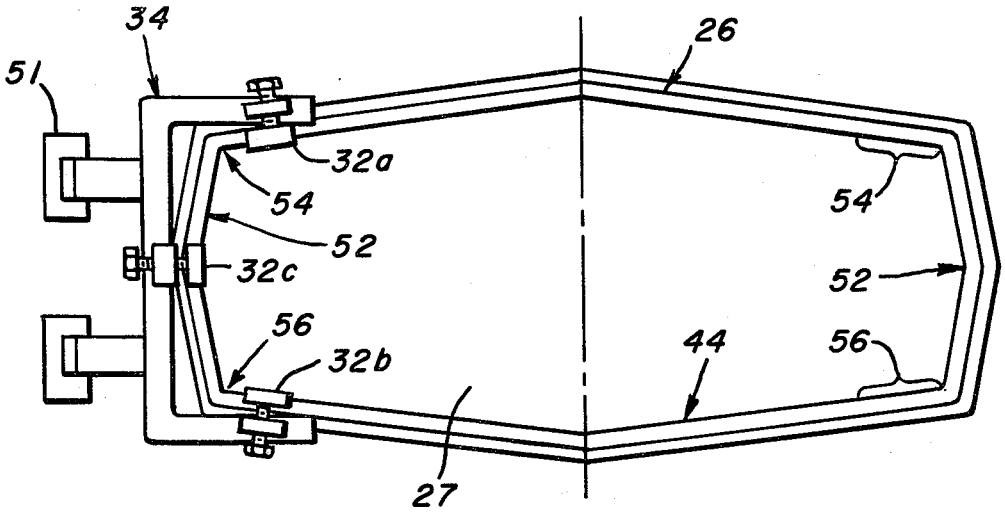
FIG. 4 is a front elevation view of a mold exit illustrating the present invention.

Various means can be used to remove the guide means once alignment is achieved and fixed. For instance, referring again to FIG. 2, screw 45 could be backed out sufficiently to pull guide shoe 42 outwardly past lip surface 44 or guide block 38 could pivot along line 47 to effect a similar result. However, the system shown in FIG. 4 offers certain advantages in straightforward operation and minimal need for readjustment of screws 45. It is desired that removal of guide means 32 proceed independent from withdrawal or movement of starter block 37 to permit movement of the guide means after the starter head is aligned and affixed in substantial alignment and before actual start-up of a casting run. In FIG. 4 support frame 34 for guide means 32 is a C-shaped member sized to position a guide means 32 at the outer top (**32*a*) and outer bottom (32*b*) regions and at each side or edge side (32*c*) of the opening 27 for mold 26. That is, guide means and supporting C-frame are positioned on both sides of the mold as shown for the left side viewing FIG. 4. As shown in FIG. 4, the C-frame 34 corresponds generally to the edge side region of the mold opening 27 and extends along lateral edge side 52 of mold 26 and around and along the laterally outer region 54 of the upper mold inside surface 44 and around and along the laterally outer region 56 of the lower mold inside surface. It is seen in FIG. 4 that a "C" frame configuration generally approximating the outer lateral extremities of the mold opening 27 but describing a periphery slightly larger than the mold opening is quite suitable to position guide means 32 to support the starter head 36. The C-frame 34 is pivotably mounted as by hinges 51 to support wall 25 (FIG. 1) carrying mold 26 or even to the mold 26 structure itself. For casting, frame 34 is simply pivoted out of the way, as shown on the right side of FIG. 4. When it is desired to restart after stopping a casting operation, the C-frame members 34 are simply repositioned on each side of the mold to position the guide means, as shown in FIGS. 1 and 2 and the left side of FIG. 4. Some means (not shown) such as hooks, quick-release arms or the like should be provided to hold frame 34 in place at the mold opening. The system in FIG. 4 thus features two C-shaped frames pivotably mounted on each side of the mold. Each frame carries two or preferably three or more guide means 32** for positive alignment and centering of the starter closure within the mold substantially without risk of mold damage. Each frame is pivotable out of the way for continuous casting and is repositionable for the next casting run with minimal procedures or adjustments.

Figure 5:
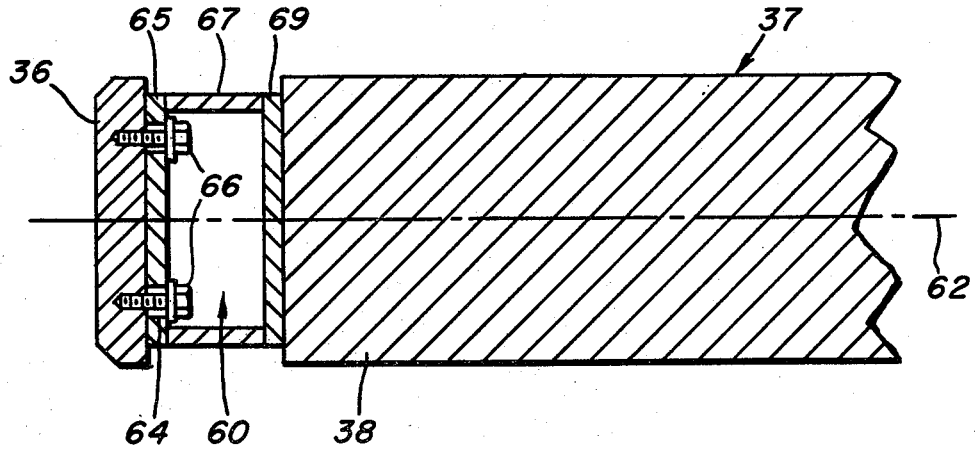
FIG. 5 is a side elevation view in cross section showing the improved starting block arrangement.
Figure 6:
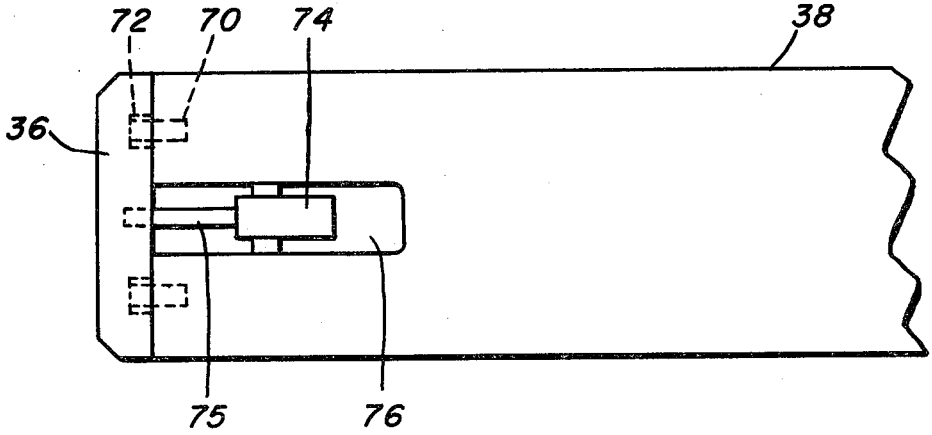
FIG. 6 is a side elevation view of an alternative starting block arrangement.

Turning now to starter block assembly 37 and referring to FIG. 5, starter block assembly 37 includes main or primary starter block 38 and spacer assembly 60 for connection to starter head 36. Spacer assembly 60 is rigidly attached to main starter block 38 as by bolts or fasteners through rear plate 69 but is connected to starter head 36 so as to allow for movement of starter head 36 lateral to the axis 62 of starter block assembly 37. This lateral movement can be effected by using threaded connector 66 attached to starter head 36 and passing through oversize holes 64 in front plate 65 of spacer assembly 60. Spacer web plates 67 connect front plate 65 to rear plate 69 and are shown as horizontal in FIG. 5 for clarity, but it is preferred to position them in a vertical plane normal to FIG. 5 since vertical spacer web plates 67 would tend to provide greater vertical support. As shown in FIG. 5, holes 64 are larger than the shank for threaded fasteners 66 which allows starter head 36 to be moved in the plane normal to axis 62 so long as fasteners 66 are not tight. Placing grease or lubricant between starter head 36 and plate 65 further facilitates easy movement and grease grooves can be cut into plate 65 to retain the lubricant. Referring to FIG. 1, it is apparent that this lateral movement of starter head 36 allows for self-alignment thereof in cooperation with guide means 32. Once the starter head 36 is positioned within the mold opening 27, the threaded fasteners 66 in FIG. 5 can be tightened or a quick-release means (not shown) tightened to rigidly secure starter head 36 to spacer 60 and main starter block 38 and thereby fix the centering and alignment of starter head 36 in the mold opening 27 and allow for removal of guide means 32. The arrangement in FIG. 5 including spacer 60 is convenient and easily constructed and thus preferable in such respects. The open character of the arrangement makes it convenient to rigidly affix starter head 36 to spacer 60 without disturbing the mold 26 or alignment between the mold and starter block assembly. However, the improvement contemplates other systems which allow for lateral movement of starter head 36 for self-alignment while positioning within mold opening 27 followed by rigid connection after insertion. For instance, referring to FIG. 6, main starter block 38 includes rigid pin members 70. Oversize holes 72 in starter head 36 allow some lateral movement of starter head 36 about pins 70. After insertion of starter head 36 into the mold opening, quick-connect means or turnbuckle 74 connected to starter head 36 by rod 75 and situated within depressions 76 on the side of main block 38 can be tightened on each side of the block to rigidly affix starter head 36 on the end of main starter block assembly 38.

Once the starter head 36 is properly aligned in the mold opening and rigidly connected to the starter block assembly, guide means 32 and frame 34 can be swung out of the way for casting. That is, it is not necessary to wait for casting to commence and for the starter head 36 to be withdrawn from the mold before the guide means 32 can be removed from the mold outlet which can proceed independent of the actual casting start-up.

The operation of the present invention can best be understood with reference to FIGS. 1, 2 and 4 in the preferred embodiment. C-shaped frame supports 34 are positioned as shown on the left side of FIG. 4 so as to position guide means 32 such that they protrude into the mold opening 27 at spaced intervals along the periphery of the opening. The extent of protrusion of guide shoe 42 of guide fixture 32 may be preset (FIG. 3) or may be adjusted (FIG. 2) while in place at the mold opening prior to alignment of starting head 36. The adjustment or setting of guide means 32 would be such that contact surface of guide shoe 42 protrudes beyond inside wall edge 44 of the mold 26 about the periphery of mold opening 27 a uniform distance for each of the guide fixtures 32. For example, 1/16 or 3/32 inch may be a typical dimension which would provide an equal clearance between starting head 36 and wall 44. The support frame 34 is secured in position by suitable locking means, not shown.

Starting block assembly 37 is then moved towards mold opening 27 by roller or conveyor means 39 and brought into start-up position with starting head 36 located just within mold opening 27. Any out of alignment condition will be corrected as starting head 36 contacts guide shoes 42. At this point in the alignment operation, fastening means 66 loosely secures spacer member 60 to starting head 36 to allow for movement of the latter transverse to axis 62. Any out of alignment causes the starting head 36 to shift or move relative to spacer member 60 along the interfacial plane therebetween. Following insertion of starting head 36 the desired distance into mold opening 27, starting head 36 is rigidly secured to spacer assembly 60. Then the guide means 32 are moved by pivoting frame 34 which moves guide means 32 from the mold outlet and from contact with starter head 36. The gap between the starter head and mold inside surface 44 is plugged with heat resistant clay. The casting operation can then be commenced.

The invention is particularly suited to arrangements for casting large ingots of substantially rectangular cross section such as a cross section of 10 to 30 inches thick by 20 to 80 inches wide where the inherent size of the mold and starter block gives rise to significant risk of damage to relatively fragile mold members such as inside surface lip 44.

Although preferred embodiments and alternative embodiments of the mold alignment device of the present invention have been illustrated and described, it will be apparent to those skilled in the art that numerous changes and variations can be made therein without departing from the scope of the invention.

What is claimed is:

1. In combination with horizontal direct continuous casting apparatus including an open-ended mold assembly having a horizontal longitudinal mold axis, and a mold closure means adapted to be inserted into the exit end of said mold for initiation of casting, an improved alignment system comprising:

(a) a plurality of guide means positionable at intervals along the periphery of said mold outlet and having surfaces extending inwardly with respect to the inside mold continuous casting surface for contact with said mold closure means and adapted to guide said mold closure means within the exit end of said mold and laterally to the mold axis;

(b) said mold closure means comprising a starter head movably securable to a starter block assembly positionable within ingot withdrawal means such that as said starter head is advanced to and within said guide means at said mold exit, said starter head is movable laterally with respect to the direction of said advancement in response to the action of said guide means to align said starter head in said mold;

(c) means to affix said starter head to said starter block assembly, said means being adapted to so affix said starter head while said starter head is positioned in alignment within said guide means and prevent movement of said starter head lateral to the axis of said mold; and (d) means to position said guide means at said exit end of said mold for aligning said starter head in said mold and to remove said guide means from said mold exit and contact with said starter head and closure means while said starter head is rigidly affixed to said starter block assembly and positioned within said mold exit, said means to position and remove said guide means comprising a C-shaped support frame pivotably mounted on each lateral side of said mold opening, each said frame carrying a plurality of said guide means, said C-shaped frame corresponding to the lateral edge side portions of said mold opening periphery and extending along said edge side and around and along the laterally outer regions of the upper and lower mold opening, said C-shaped frame being pivotably positionable at said mold outlet such that a guide means is positioned at the lateral edge side, an upper mold opening surface and at a lower mold opening surface for alignment of said mold closure means, said C-shaped frame being adapted to swing out of said mold outlet region for removal of said guide means from said mold exit.

2. The improved system according to claim 1 wherein said support frame is pivotably mounted to the mold structure.

3. The improved system according to claim 1 wherein at least one of said C-shaped frames carries at least three of said guide means.

4. The improved system according to claim 1 wherein said means to remove said guide means is adapted to do so while said starter head is positioned substantially as aligned within said mold opening.

5. The improved system according to claim 1 wherein said guide means has a base portion supported by said support frame and a contact shoe portion at least partially supported by a surface of said mold assembly where said guide means is positioned at said mold outlet.

6. The improved system according to claim 1 wherein said guide means includes a flared surface converging into said mold opening axis for guiding and centering said starter head away from contact with said mold inside surface as the starter head is inserted into said mold.

7. The improved system according to claim 1 wherein said starter head includes a tapered surface converging into said mold opening for guiding said starter head into alignment with said guide means.

8. The improved system according to claim 1 wherein said starter head is separated from said starter block by a spacer arrangement rigidly secured at a first end and movably connected at the opposite end to allow for movement and alignment of said starter head in response to said guide means.

9. The improved system according to claim 8 wherein means is provided for rigid fixing at said opposite end whereby said starter head becomes rigidly connected to said starter block by said spacer arrangement.

10. The improved system according to claim 8 wherein said spacer arrangement comprises opposite facing plates separated by at least one web.

11. The improved system according to claim 1 wherein said mold opening corresponds to an ingot cross-section of 10 to 30 inches in thickness by 20 to 80 inches in width.

12. In combination with horizontal direct continuous casting apparatus including an open-ended mold assembly having a horizontal longitudinal mold axis, ingot withdrawal means and a mold closure means adapted to be inserted into the exit end of said mold and removable therefrom by said ingot withdrawal means for initiation of casting, an improved alignment system comprising:

(a) a plurality of guide means positionable at intervals along the periphery of the outer lateral edge regions of said mold outlet and having surfaces extending inwardly with respect to the inside mold continuous casting surface for contact with said mold closure means and adapted to guide and center said mold closure means within the exit end of said mold and laterally to the mold axis;

(b) said mold closure means comprising a starter head movably connected to a starter block assembly positioned within said ingot withdrawal means such that as said starter head is advanced to and within said guide means at said mold exit by advancement of said starter block by said ingot withdrawal means, said starter head is movable laterally with respect to the direction of said advancement in response to the action of said guide means to align said starter head in said mold;

(c) means to affix said starter head to said starter block assembly, said means being adapted to so affix said starter head while said starter head is positioned in alignment within said mold opening and guide means and prevent movement of the starter head lateral to the axis of the mold; and (d) means to position said guide means at said exit end of said mold for aligning said starter head in said mold and to remove said guide means from said mold exit and contact with said starter head and closure means while said starter head is rigidly affixed to said starter block assembly and positioned within said mold exit, said means to position and remove said guide means comprising a C-shaped support frame pivotably mounted on each lateral side of said mold opening, each said frame carrying a plurality of said guide means, said C-shaped frame corresponding to the lateral edge side portions of said mold opening periphery and extending along said edge side and around and along the laterally outer regions of the upper and lower mold opening, said C-shaped frame being pivotably positionable at said mold outlet such that a guide means is positioned at the lateral edge side, an upper mold opening surface and at a lower mold opening surface for alignment of said mold closure means, said C-shaped frame being adapted to swing out of said mold outlet region for removal of said guide means from said mold exit.

13. The improved system according to claim 12 wherein said mold assembly is arranged to provide partial support for said guide means when positioned at said mold exit.

14. The improved system according to claim 12 wherein the exit region of said mold assembly includes a surface converging with said mold axis into said mold and arranged to provide partial support and positioning for said guide means.

15. The improved system according to claim 12 wherein said starter head is separated from said starter block by a spacer arrangement rigidly secured at a first end and movably connected at the opposite end to allow for movement and alignment of said starter head in response to said guide means, means being provided for rigid fixing at said opposite end whereby said starter head becomes rigidly connected to said starter block by said spacer arrangement.

* * * * *